US009967919B2

(12) United States Patent
López Rodriguez et al.

(10) Patent No.: US 9,967,919 B2
(45) Date of Patent: May 8, 2018

(54) ELECTRICAL RESISTOR HEATING

(71) Applicant: Hewlett-Packard Development Company, L.P., Houston, TX (US)

(72) Inventors: Juan Luis López Rodriguez, Subirats (ES); Xavier Soler Pedemonte, Barcelona (ES); Jesús Garcia Maza, Terrassa (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/092,370

(22) Filed: Apr. 6, 2016

(65) Prior Publication Data

US 2016/0249410 A1 Aug. 25, 2016

Related U.S. Application Data

(62) Division of application No. 14/417,509, filed as application No. PCT/EP2012/003172 on Jul. 26, 2012, now Pat. No. 9,345,068.

(51) Int. Cl.

| | |
|---|---|
| ***H05B 1/02*** | (2006.01) |
| ***B41J 11/00*** | (2006.01) |
| ***H05B 3/02*** | (2006.01) |

(52) U.S. Cl.

CPC ..... *H05B 1/023* (2013.01); *B41J 11/002* (2013.01); *B41J 11/0015* (2013.01); *H05B 1/0227* (2013.01); *H05B 3/026* (2013.01)

(58) Field of Classification Search

CPC .... H05B 1/023; H05B 1/0227; H05B 1/0241; B41J 11/0015; B41J 11/02

(Continued)

(56) References Cited

U.S. PATENT DOCUMENTS

| | | | |
|---|---|---|---|
| 5,483,149 | A | 1/1996 | Barrett |
| 5,512,993 | A | 4/1996 | Endo et al. |

(Continued)

FOREIGN PATENT DOCUMENTS

| | | |
|---|---|---|
| EP | 1303168 | 4/2003 |
| JP | 10091036 | 4/1998 |
| JP | H1173057 | 3/1999 |

OTHER PUBLICATIONS

International Search Report and Written Opinion dated Mar. 7, 2013, issued on PCT Patent Application No. PCT/EP2012/003172 filed Jul. 26, 2012, European Patent Office.

(Continued)

*Primary Examiner* — Mark Paschall

(74) *Attorney, Agent, or Firm* — HP Inc. Patent Department

(57) ABSTRACT

Electrical resistor heating with an electrical resistor heating circuitry which includes an AC power source of at least one phase, a plurality of heating resistors provided in a spatial arrangement, and switches to connect the AC power source with the heating resistors generating ON and OFF power states. Power scheduling is provided to adjust the power fed from the AC power source to the heating resistors at a desired partial-power level by ON/OFF switching a number of switches, wherein the power scheduling causes at least some of the switches to switch between the ON and OFF states in a staggered manner so that energization of the partial-power level of different resistors takes place, at least partially, non-simultaneously.

16 Claims, 6 Drawing Sheets

(58) Field of Classification Search
USPC ..... 219/486, 483, 494, 497, 216; 355/69, 70
See application file for complete search history.

(56) References Cited

U.S. PATENT DOCUMENTS

| | | | | |
|---|---|---|---|---|
| 5,847,367 | A | 12/1998 | Hancock et al. | |
| 5,990,459 | A | 11/1999 | Feustel et al. | |
| 6,311,091 | B1 | 10/2001 | Yamahira | |
| 6,508,552 | B1 * | 1/2003 | Steinfield | B41J 11/002 347/102 |
| 6,946,626 | B2 | 9/2005 | Hirayama et al. | |
| 8,036,558 | B2 | 10/2011 | Nakashima | |
| 9,266,357 | B1 * | 2/2016 | Facchini, II | B41J 11/0045 |
| 9,463,649 | B1 * | 10/2016 | Liu | B41J 3/543 |
| 2004/0061752 | A1 * | 4/2004 | Alfekri | B41J 11/0015 347/99 |
| 2009/0244236 | A1 * | 10/2009 | Houjou | B41J 11/002 347/102 |
| 2010/0265292 | A1 * | 10/2010 | Ohshima | B41J 2/1606 347/16 |
| 2012/0013663 | A1 | 1/2012 | Snyder et al. | |
| 2013/0098895 | A1 | 4/2013 | Swanson et al. | |

OTHER PUBLICATIONS

Phillip H. Jones, et al., "A Thermal Management and Profiling Method for Reconfigurable Hardware Applications", Aug. 28-30, 2006, pp. 103-109.

* cited by examiner

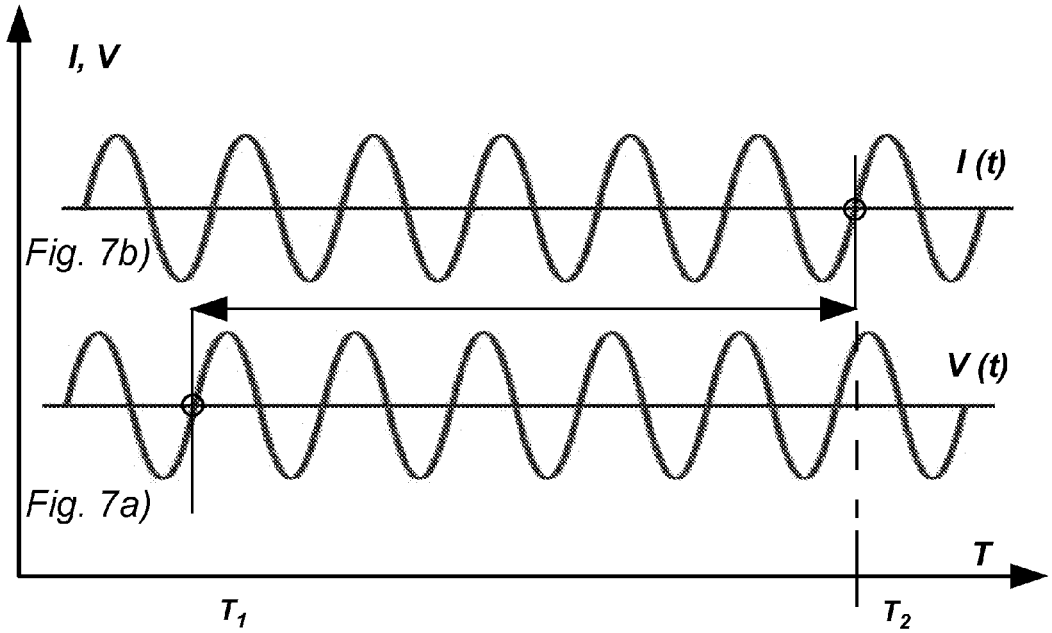
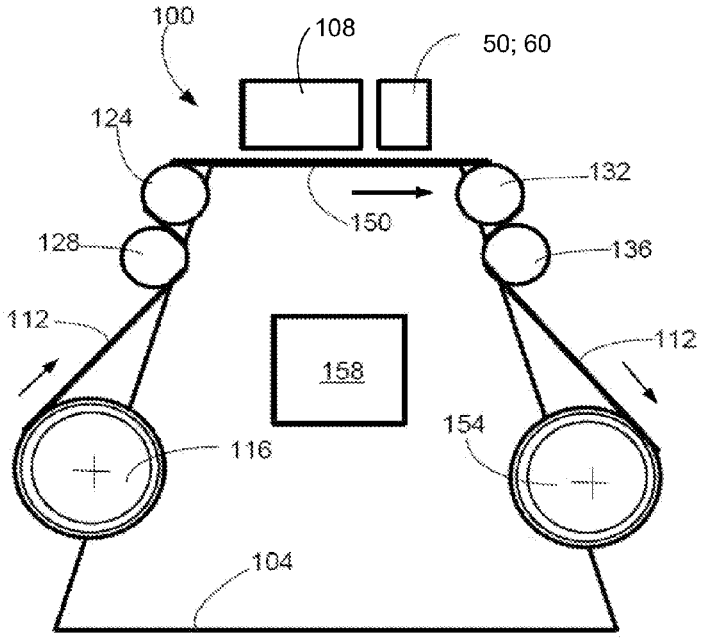
Fig. 8

ELECTRICAL RESISTOR HEATING

PRIORITY

This application is a Divisional of commonly assigned and copending U.S. patent application Ser. No. 14/417,509, filed Jan. 26, 2015, which is a national stage filing under 35 U.S.C. § 371 of PCT application number PCT/EP2012/003172, having an international filing date of Jul. 26, 2012, the disclosures of which are hereby incorporated by reference in their entireties.

FIELD OF THE INVENTION

The invention relates to electrical resistor heating.

SUMMARY OF THE INVENTION

An example of the invention provides an electrical resistor heating circuitry comprising an AC power source of at least one phase, a plurality of heating resistors provided in a spatial arrangement, a number of switches provided between the AC power source and the heating resistors and adapted to switch between ON and OFF states, a power scheduler arranged to adjust the power fed from the AC power source to the heating resistors and a desired partial-power level by outputting ON/OFF switching signals to the switches. The power scheduler is arranged to generate the switching signals to cause at least some of the switches to switch between the ON and OFF states in a staggered manner, so that energization at the partial-power level of different resistors takes place, at least partially, non-simultaneously.

According to another example, a method is provided of electrical resistor heating with an electrical resistor heating circuitry comprising an AC power source of at least one phase, a plurality of heating resistors provided in a spatial arrangement, wherein switches are provided between the AC power source and the heating resistors and adapted to switch between ON and OFF power states. The method comprises power scheduling to adjust the power fed from the AC power source to the heating resistors and a desired partial-power level by ON/OFF switching a number of switches, wherein the power scheduling causes at least some of the switches to switch between the ON and OFF states in a staggered manner so that energization of the partial-power level of different resistors takes place, at least partially, non-simultaneously.

BRIEF DESCRIPTION OF THE DRAWINGS

Examples of the present invention will now be described, by way of example only, with reference to the accompanying drawings in which corresponding reference numerals indicate corresponding items and in which:

FIG. 7*a*) and *b*) are time diagrams of voltage V and current I of an AC power source and the switching between ON and OFF states in accordance with one example.

The drawings and the description of the drawings are examples of the invention and not of the invention itself.

FIG. 8 is a schematic illustration of a printer in the form of a wide format inkjet printer in accordance with one example.

DETAILED DESCRIPTION OF EXAMPLES

Figure 1:
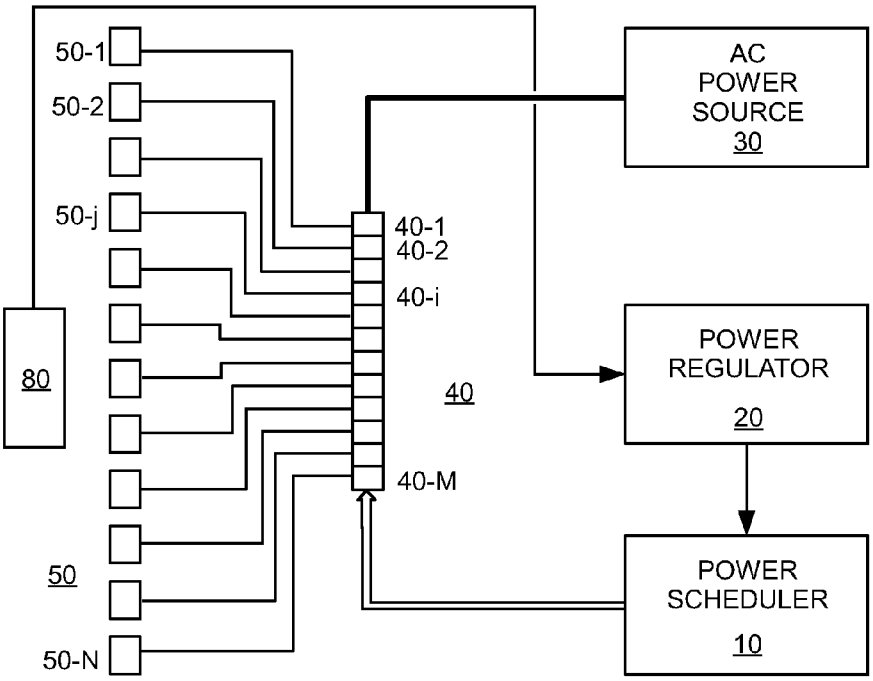
FIG. 1 is a schematic diagram of an electrical resistor heating circuitry of an example.

FIG. 1 illustrates in a simplified schematic diagram an electrical resistor heating circuitry which includes an AC power source 30 of at least one phase which is arranged to provide power for a heat source 50 which is provided by a plurality of N heating resistors 50-1, 50-2, . . . 50-j, . . . 50-N provided in a spatial arrangement. Between the AC power source and the heating resistors 50-1, 50-2, . . . 50-j, . . . 50-N of the heat source 50 a number of M switches 40-1, 40-2, . . . 40-i, . . . 40-M are provided which are adapted to switch between ON and OFF states.

The electrical resistor heating circuitry further includes a power scheduler 10 which is arranged to adjust the power fed from the AC power source 30 to the heating resistors 50-1, 50-2, . . . 50-j, . . . 50-N at a desired partial-power level by outputting ON/OFF switching signals to the switches 40-1, 40-2, . . . 40-i, . . . 40-M, as indicated by the block arrow.

Generally, the power scheduler 10 is arranged to generate the switching signals to cause at least some of the switches 40-1, 40-2, . . . 40-i, . . . 40-M to switch between the ON and OFF states in a staggered manner so that energization of the different heating resistors 50-1, 50-2, . . . 50-j, . . . 50-N takes place, at least partially, non-simultaneously.

In the example shown in FIG. 1, the switching circuitry comprises a set of electrical switches 40-1, 40-2, . . . 40-i, . . . 40-M of which each one is connected between the AC power source 30 and one of the plurality of heating resistors 50-1, 50-2, . . . , 50-j, 50-N (i.e. here is M=N) and is adapted to switch between an ON state and an OFF state in response to the ON/OFF switching signals as output from the power scheduler 10.

Figure 2A:
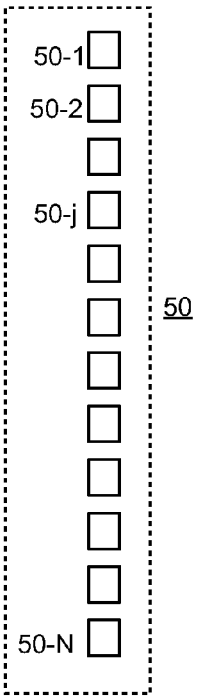
FIG. 2*a*) and *b*) are schematic representations of spatial arrangements of a plurality of heating resistors as they may be included in the electrical resistor heating circuitry of FIG. 1 according to examples.
Figure 2B:
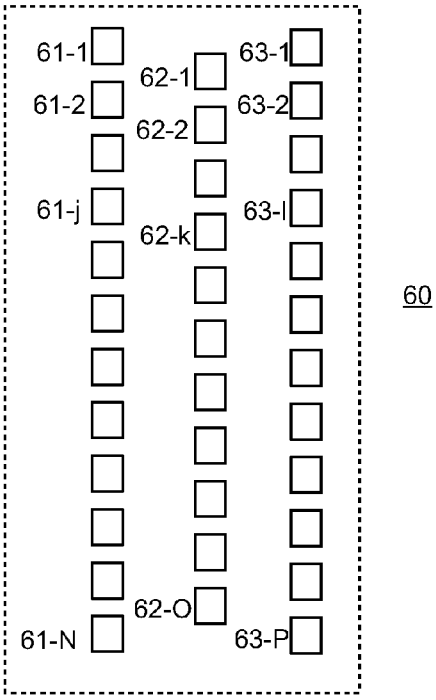

Examples of the spatial arrangement of heating resistors are shown in FIGS. 2(*a*) and (*b*). FIG. 2(*a*) shows an arrangement where a plurality of heating resistors 50-1, 50-2, . . . 50-j, . . . 50-N are arranged in a row.

In the example shown in FIG. 2(*b*), the plurality of heating resistors are provided in a spatial arrangement in the form of an array of several columns, in the example shown of three columns 61, 62, 63, where each column includes a row of a number of heating resistors 61-1, 61-2, . . . 61-j . . . 61-N, 62-1, 62-2, . . . 62-k, . . . 62-O, 63-1, 63-2, . . . 63-I, . . . 63-P.

The spatial arrangements of heating resistors, as shown in FIGS. 1, 2*a*) and 2*b*) are for illustrative purposes only, the number of heating resistors and the spatial arrangement thereof can be different, they need not be arranged in columns and rows, the number thereof can be much larger or also smaller than shown.

The electrical resistor heating circuitry of FIG. 1 further shows an electrical power regulator 20 which is arranged to generate power-ordering signals which indicate the desired partial-power level, and to send those power-ordering signals to the power scheduler 10. The power scheduler 10 is arranged to generate the ON/OFF switching signals in response to the power-ordering signals from the power regulator 20 and to send them to the switching device 40 to achieve the desired partial-power level.

In the example shown in FIG. 1, a sensor device 80 is provided to generate a signal which, generally, represents a value on which the desired partial-power level is dependent, wherein the power regulator 20 is arranged to generate the power-ordering signals dependent on this input signal.

The sensor device 80 of the example shown in FIG. 1 may include one or more sensors or a sensor array, which may be a temperature sensor, an optical sensor, a humidity sensor or any other appropriate type of sensor to generate an input signal for the power regulator 20, as a basis on which the power-ordering signals are generated.

According to one example, the electrical resistor heating circuitry is included in an inkjet printer and is arranged for drying a printed substrate. An example of such a printer is shown in FIG. 8.

FIG. 8 is a schematic illustration of a printer in the form of a wide format inkjet printer. Printer 100 includes a rigid frame 104 on which a print-head 108 is arranged to be moved in a reciprocating type of movement across a flexible substrate 112. Typically, this reciprocating movement, which often is referred to as swathing, is in a direction perpendicular to the drawing plane of FIG. 1.

Mounted on the frame 104 are components of a feed-path for the flexible substrate 112 which include a substrate supply-roll 116, a substrate drive-roll 124 and, associated with the substrate drive-roll 124, a first or drive-roll pressure-roll 128. Spaced apart from the drive-roll 124, there is a substrate tension-providing-roll 132 and, associated with the substrate tension-providing-roll 132, a second pressure-roll 136. The drive-roll 124, the first pressure roll 128, the tension-providing-roll 132 and the second pressure-roll 136 span at least the width of the substrate 112 on which printing is performed. For example, in the case of a wide format printer, the substrate may be 5 meters (5000 mm) wide and the rolls 124, 128, 132 and 136 will be of a similar length. Since the rolls are relatively long, each of them or some of them may be supported by a series of clamping rolls for applying a support force directly to the surface of the rolls through a rolling contact.

Also shown in FIG. 8 is a support surface 150 for the flexible substrate 112, over which printing takes place and which includes a printing area on which printing is performed by the print-head 108. The support surface 150 is located in a space between the drive-roll 124 and the tension-providing-roll 132.

The substrate 112, after having been printed, may be collected on a collection-roll 154, or it may be collected as a free-fall substrate.

The printer 100 further includes a control unit 158 which is arranged for controlling the rotation speed of all rolls, the operation of the radiation sources or drying-heat-emitting sources, synchronisation of all the units, and, of course, the printing process itself, i.e. receiving, processing and generating image-representing data and forwarding them to the print-head 108.

The substrate 112, as a web, is threaded through the substrate feed-path from the substrate supply-roll 116, on which the substrate 112 is stored, through the first pressure-roll 128 and the substrate drive-roll 124 and over the support surface 150 where the printing takes place in the printing area. In operation, the substrate drive-roll 124 is caused to rotate at a first speed, and the tension-providing-roll 132 is caused to rotate at a second, different, speed which is higher than the first rotation speed, and the difference in the rotation speeds of the two rolls 124, 132 generates a constant tension (back tension) as a force which keeps the substrate 112 flat in a section of a web of substrate 112 located between the spaced apart drive-roll 124 and tension-roll 132 and including the printing area on the support surface 150. The web of substrate 112 is pulled over the support surface 150 past the tension-providing-roll 132 and the second pressure-roll 136, as shown by the arrow in FIG. 1, towards the substrate collection-roll 154.

Radiation sources for ink-curing or ink-drying sources may be attached to or near the print-head 108 and may move in the same reciprocating movement as the print-head 108 or may have separate drives or, may also be stationary.

In the example shown, a heat source 50; 60 which includes a plurality of heating resistors 50-1, 50-2, . . . 50-j, . . . 50-N; 60-1, 60-2, . . . 60-j, . . . 60-N as exemplified in FIGS. 1, 2*a*) and *b*) is arranged downstream with respect to the substrate or printing-media-feed direction as indicated by the arrow for curing or drying ink printed on the substrate.

In general, the power scheduler may be provided by at least one of a Field Programmable Gate Array (FPGA), a microprocessor, a discrete digital circuitry, an Application Specific Integrated Circuitry (ASIC), a discrete analog circuitry and a sequence generator based on counter addressing a memory device.

Figure 3:
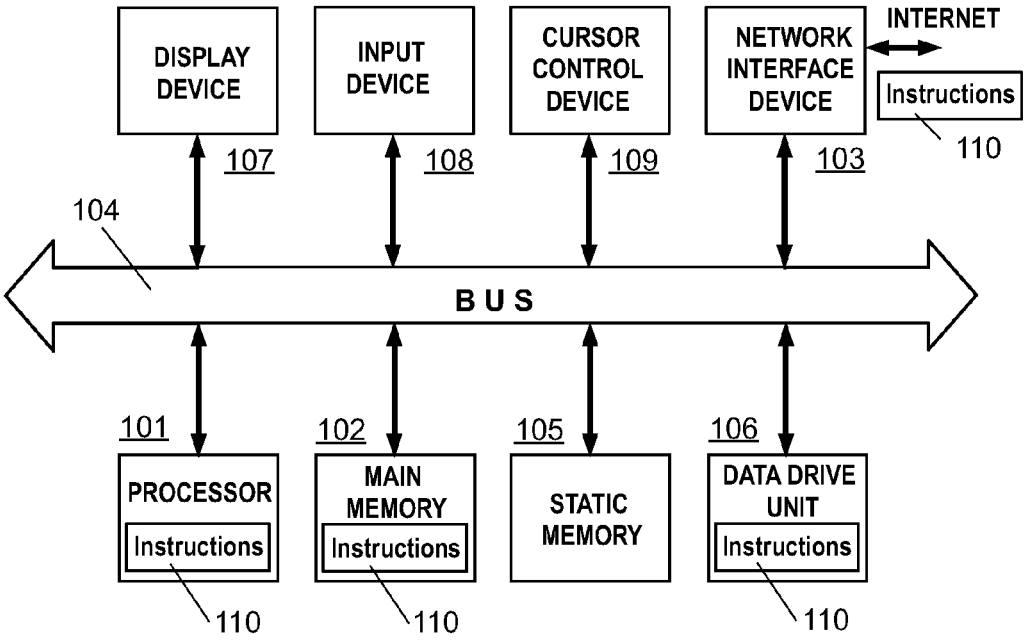
FIG. 3 is a diagrammatic representation of a computer system as it may be arranged to provide functionalities implemented in an example.

FIG. 3 shows a diagrammatic representation of an example of a computer system as it may be arranged to provide the functionality of the controller 158 of the printer exemplified in FIG. 8. The same computer system also may be arranged to provide the functionalities of the power scheduler 10 of FIG. 1. The computer system additionally may provide the functionality of the power regulator 20.

Consequently, the computer system is configured to execute a set of instructions to perform the described tasks of the power scheduler 10, optionally also of the power regulator 20 and/or the controller 158 of the printer in FIG. 8.

The computer system as exemplified in FIG. 3 includes a processor 101 and a main memory 102, which communicate with each other via a bus 104.

Optionally, the computer system may further include a static memory 105 and/or a non-transitory memory in the form of, for example, a data drive unit 106 which may be e.g. a solid state memory or a magnetic or an optical disk-drive unit. A display device 107, an alpha-numeric input device 108 and a cursor control device 109 may form an input/output device for a user. Additionally, a network interface device 103 can be provided to connect the computer system to an Intranet or to the Internet as a data-processing environment or network.

A set of instructions (i.e. software) 110 embodying some or all of the functionalities of the power scheduler 10 and/or the regulator 20 of FIG. 1 and/or the controller 158 in the printer of FIG. 8, for example, may reside completely, or at least partially in or on a machine-readable medium, e.g. the main memory 102 and/or the processor 101. A machine-readable medium on which the software 110 resides may also be a data carrier, e.g. a solid-state memory or a data drive, a non-removable magnetic hard disk or an optical or a magnetic removable disk which may be part of the data drive unit 106. The software 110 may also be transmitted or received as a propagated signal via the Intranet or the Internet through the exemplified network interface 103, which also can be used for updating the software or for other purposes.

It should be noted that the circuitry example of FIG. 3 is for illustrative purposes only and that the implementation of the printer controller 158, power scheduler 10, the switching device 40 and/or the power regulator 20 are not limited to these examples.

Figure 4A:
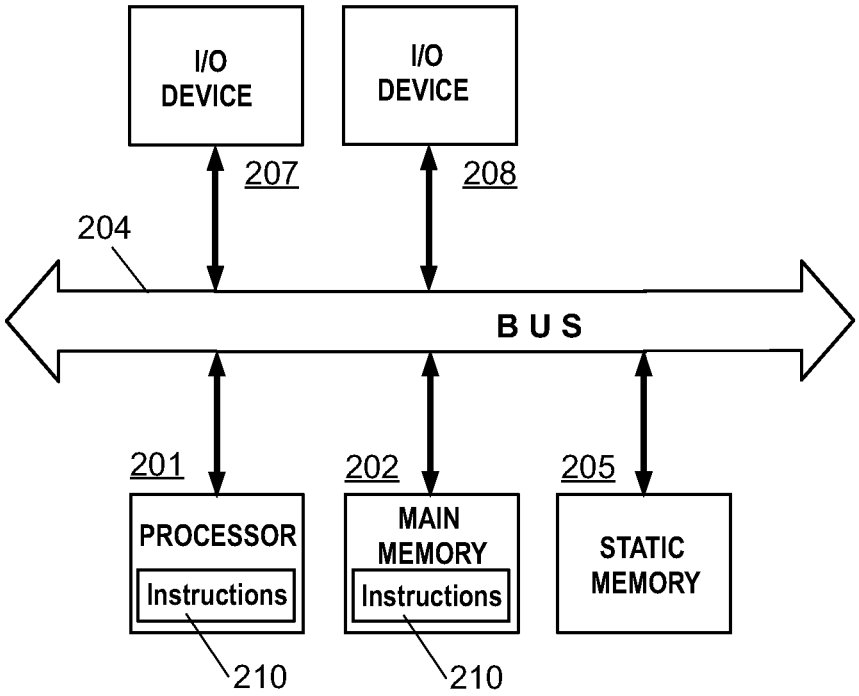
FIG. 4*a*) is a diagrammatic representation of a computer system as it may be arranged to provide functionalities implemented in the electrical resistor heating circuitry in accordance with an example.

FIG. 4*a*) is a diagrammatic representation of another example of a computer system as it may be arranged to provide the functionality of the power scheduler 10 of FIG. 1, it also may be arranged to provide the functionality of both the power scheduler 10 and the power regulator 20 of FIG. 1. Similarly, as the computer system shown in FIG. 3, the system includes a processor 201 and a main memory 202 which communicate with each other via a bus 204. The computer system may also include a static and/or non-transitory memory 205.

In the system shown in FIG. 4*a*), the computer system includes a first input/output device 207 and a second input/output device 208 of which the first one 207 is arranged to be connected to the switch device 40 of FIG. 1, whereas the second one 208 is arranged to communicate with the power regulator 20 or, if the power regulator 20 is implemented in the computer system, to receive the signals from the sensor device 80.

Additionally, as in the computer system of FIG. 3, further components such as a display, an alpha-numeric input device and a cursor control device and/or a network interface device for connecting to an Intranet or to the Internet might be included in the computer system of FIG. 4*a*). A set of instructions, i.e. software 210 embodying any one, or all, of the tasks performed by the power scheduler 10 and, optionally, the power regulator 20, may reside completely, or at least partially, in or on a machine-readable medium, e.g. the main memory 202 and/or the processor 201.

Figure 4B:
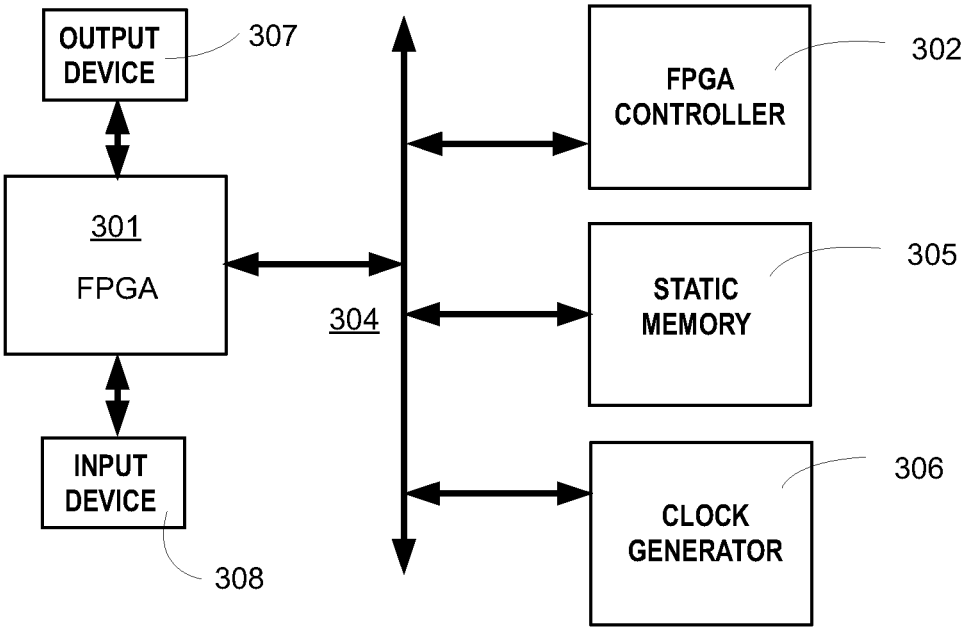
FIG. 4*b*) is a diagrammatic representation of a Field Programmable Gate Array (FPGA) system as it may be arranged to provide functionalities implemented in the electrical resistor heating circuitry in accordance with an example.

FIG. 4*b*) shows an example wherein the functionality of the power scheduler 10 or, optionally, the power scheduler 10 and the power regulator 20, of generating the switching signals for the switches included in the switch device 40, i.e. the switches 40-1, 40-2, . . . 40-i, . . . 40M, are implemented in a Field Programmable Gate Array (FPGA).

The FPGA circuitry shown in FIG. 4*b*) includes a FPGA 301 and a FPGA controller 302 which is connected to the FPGA 301 via a local bus 304. The FPGA controller 302, for example, may be provided by a second FPGA. The FPGA 301 and FPGA controller 302 also may be implemented in a single FPGA. Also connected to the local bus 304 is a static and/or non-transitory memory 305 and a clock generator 306. Connected to the FPGA is an input device 308 and an output device 307. The input device 308 may be arranged to receive the power-ordering signals from the power generator 20 of FIG. 1, if this is not included in the FPGA circuitry, or, if the power regulator 20 is included in the FPGA circuit, it may be arranged to receive the input signal to the power regulator 20 as derived from the sensor device 80. The output device 307 provides the ON/OFF switching signals for the switches 40-1, 40-2, . . . 40-i, . . . 40-M which are included in the switching device 40.

It should be noted that the circuitry examples of FIGS. 4*a*) and 4*b*) are for illustrative purposes only and that the implementation of the power scheduler 10, the switching device 40 and/or the power regulator 20 are not limited to these examples.

Figure 5A:
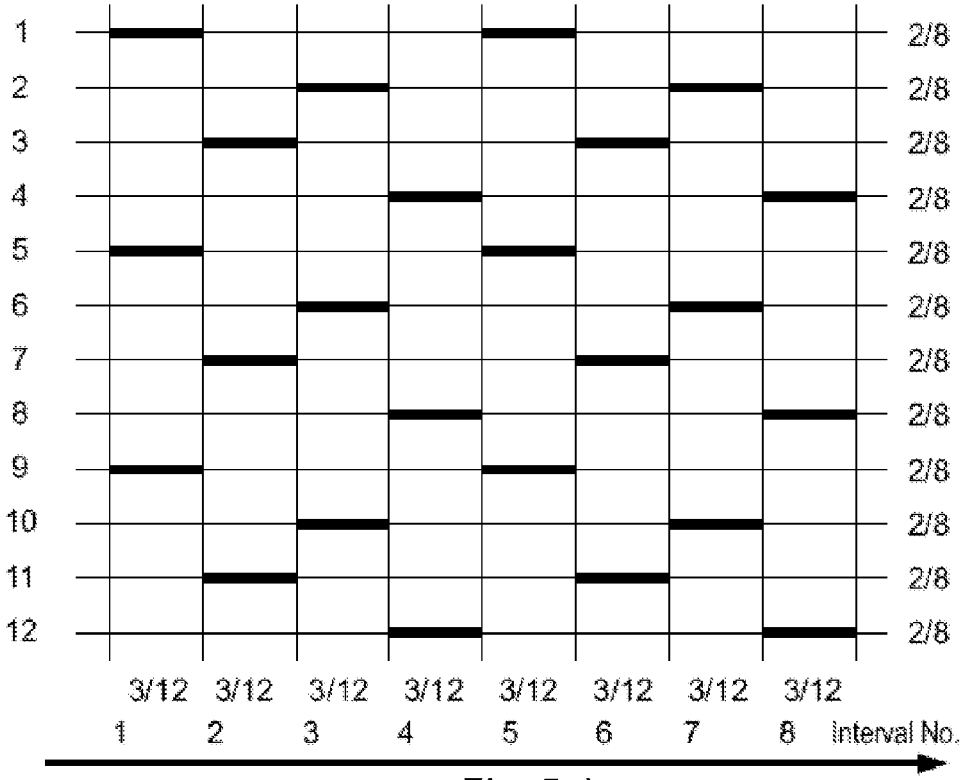
FIG. 5*a*) and *b*) are time diagrams which illustrate the switching of a number of switches between ON and OFF states in accordance with two examples.

FIGS. 5*a*), 5*b*), 6*a*) and 6*b*), show examples of power scheduling as performed by the power scheduler 10 to produce the ON/OFF signals for the switches of the switch device 40 in a staggered manner, so that energization of the partial-power level of the different resistors in the heat source 50, as exemplified in FIG. 1, takes place, at least partially, non-simultaneously.

In the FIGS. 5*a*), 5*b*), 6*a*) and 6*b*) a timing schedule of a plurality of, by way of example, twelve heating resistors 1 . . . 12 is shown dependent on time T for a number of, by way of example, eight time intervals 1 through 8. In the respective lines for each of the heating resistors 1 through 12, the ON state is shown by a bold line in the respective time intervals 1 through 8, whereas the OFF state is shown by a thin line. At the right-hand end of each of the lines associated with the heating resistors 1 through 12, the (total) number of ON state intervals within the eight intervals shown 1 . . . 8 for the respective heating resistor is indicated. At the lower end of each of the time intervals 1 through 8, the (total) number of ON states among the heating resistors 1 through 12 in the respective time interval is indicated.

In the examples shown in FIGS. 5*a*) and 5*b*), the spatial power distribution of the heating resistors over the time intervals 1 through 8 is uniform because the sum of ON state intervals is the same for each of the heating resistors 1 through 12, i.e. in the example of FIG. 5(*a*) each of the heating resistors 1 through 12 has two ON states during the time intervals 1 through 8 which means a partial-power level of 2/8=25%. The (total) number of ON states among the heating resistors 1 through 12 in each of the time intervals 1 through 8 is three, i.e. in each time interval constantly three of the twelve heating resistors are in the ON state, but they are cyclically redistributed as can be seen in the diagram.

Figure 5B:
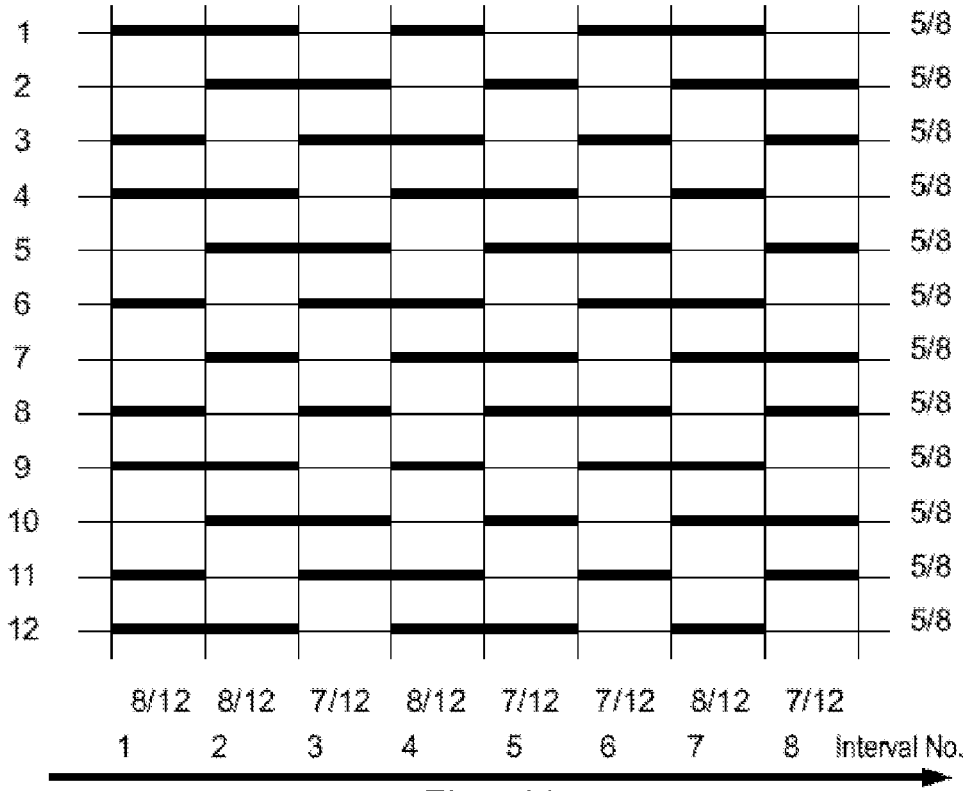

In the example of FIG. 5*b*), the spatial power distribution, when averaged over all the heating resistors 1 through 12, also is uniform at a level of 5/8=62.5%. The (total) number of ON states among the heating resistors 1 through 12 in each of the time intervals 1 through 8 is between seven and eight, i.e. in each time interval seven or eight of the twelve heating transistors are in the ON state, and they are redistributed from interval to interval, as can be seen in the diagram. In the FIGS. 6*a*) and 6*b*), spatial power distributions are shown which are non-uniform over the spatial arrangement of the heating resistors included in the heating source 40.

Figure 6A:
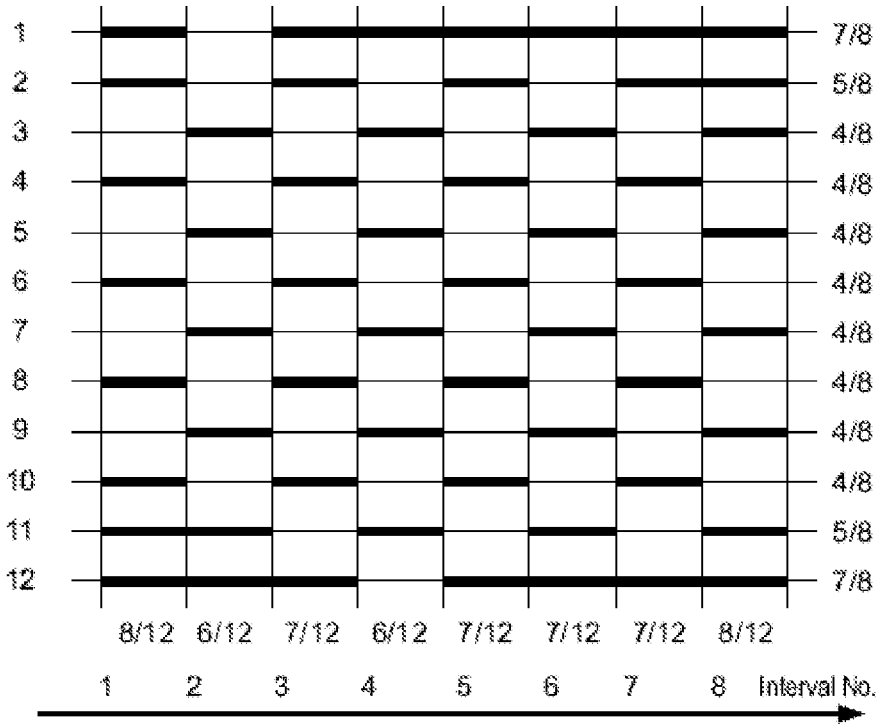
FIG. 6*a*) and *b*) are time diagrams which illustrate the switching of a number of switches between ON and OFF states in accordance with two other examples.

In the example of FIG. 6*a*), the heating resistors 3 through 10 are switched between the ON and OFF states in a manner that during the time intervals 1 through 8 each one of the switches 3 through 10 has four intervals switched ON, so that the partial-power level is 4/8=50%. However, at the ends of the spatial arrangement of the heating resistors, the resistors 1 and 2 and the resistors 11 and 12 have an enhanced power level, namely the outermost resistors 1 and 12 have seven ON states during the time intervals 1 through 8, so that the partial-power level is 7/8=87.5% and the adjacent resistors 2 and 11 have an enhanced power level of five ON stages during the time intervals 1 through 8, so that the partial-power level is 5/8=62.5%. That means that the spatial arrangement of heating resistors has a uniform partial-power level over the heating resistors 3 through 10 which are not adjacent to the ends of the spatial arrangement, whereas at the ends the power level is enhanced so as to e.g. compensate for enhanced power losses at the end. The (total) number of ON states among the heating resistors 1 through 12 in each of the time intervals 1 through 8 is between six and eight, i.e. in each time interval between six and eight of the twelve heating resistors are in the ON state, and they are redistributed from interval to interval, as can be seen in the diagram.

Figure 6B:
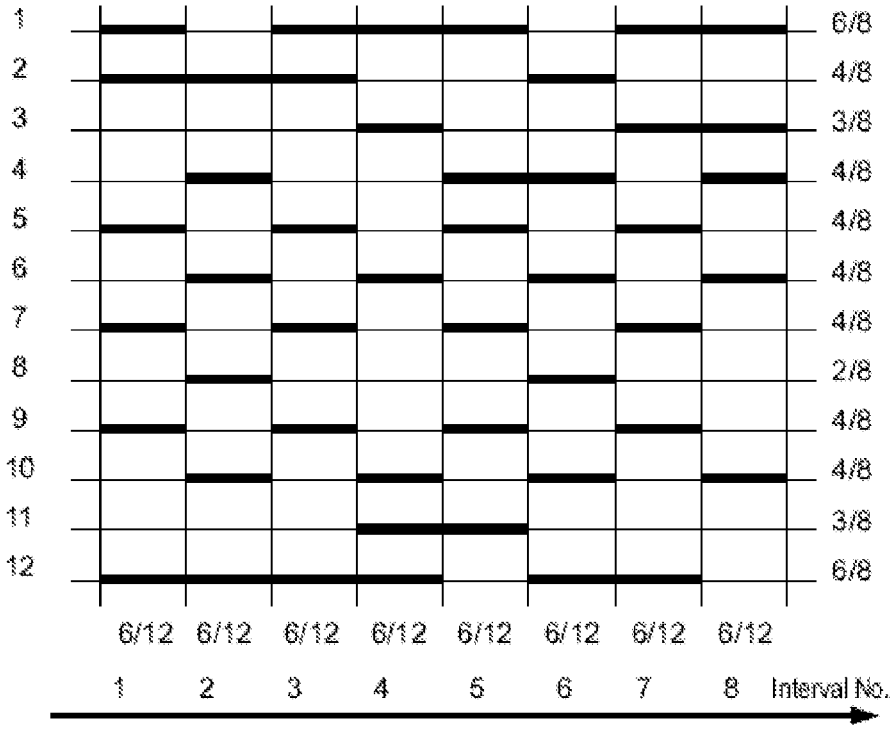

FIG. 6*b*) shows an example where the power level of the heating resistors included in the spatial arrangement is non-uniform in that the heating resistors 1 through 12 are individually switched to ON and OFF states so that they have between two and six ON states, i.e. a partial-power level between 2/8=25% and 6/8=75% during the time intervals 1 through 8. Such a non-uniform spatial power distribution may be used to comply with spatial non-uniform heat demand, for example in an inkjet printer where ink is applied in a significantly non-uniform manner on a printing media or substrate. Additionally, at the ends, i.e. at the resistors 1 and 12, the power level is enhanced so as to e.g. compensate for enhanced power losses at the end. The (total) number of ON states among the heating resistors 1 through 12 in each of the time intervals 1 through 8 constantly is six, in this example, i.e. in each time interval six of the twelve heating resistors are in the ON state, but they are redistributed from interval to interval as can be seen in the diagram. A spatial non-uniform heat demand, for example in an inkjet printer where ink is applied in a significantly non-uniform manner on a printing media or substrate, may be indicated by the sensor device 80, especially from a sensor array, or it may be derived from image data of the printer.

FIGS. 7*a*) and 7*b*) are time diagrams of voltage V and current I of an AC power source from which the heating resistors are fed via the switches included in the switch device as shown for example by reference numeral 40 in FIG. 1. In the time interval shown as an example, one of the switches is in the ON state wherein the switch changes from the OFF state to the ON state, i.e. closes, when the voltage is zero (time=$T_1$), and changes from the ON state to the OFF state, i.e. opens, when the current is zero (time=$T_2$). In this example, the power scheduler 10 is arranged to generate the ON/OFF switching signals accordingly.

Referring again to FIGS. 5*a*) and *b*) and FIGS. 6*a*) and *b*), it is understood that in these examples the ON/OFF switching of the plurality of heating resistors, as exemplified by the heating resistors 1 through 12 in these figures, includes ON switching of a first set of switches among the number of switches, and OFF switching of a second set of switches among the number of switches during a given time interval of a number of consecutive time intervals.

The number of switches of the first set, i.e. of those switched ON, and the number of switches of the second set, i.e. of those switched OFF, are selected in correspondence with the desired partial-power level, i.e. between 0% and 100%. As shown in the examples, the switches of the first set (ON state) and the switches of the second set (OFF state) are ON/OFF switched in a spatial distribution so that one or more switches of the first set alternate with one or more switches of the second set to achieve a (rough) approximation of a desired spatial power distribution. The spatial distribution of the switches of the first set (ON state) and the switches of the second set (OFF state) is altered in the consecutive time intervals, so that the desired spatial power distribution is averaged and smoothed.

In one example, the spatial distribution of the switches in the ON state of the first set and the switches in the OFF state of the second set is determined from logical data words, which are associated with the consecutive time intervals. Those logical data words include information defining the ON states and the OFF states, respectively, of each of the switches of the first set (ON state) and the second set (OFF state). The logical data words are established depending on the desired partial-power level and the desired spatial power distribution and are altered in the consecutive time intervals.

Some more general points of examples as described therein are now discussed:

In general, the electrical resistor heating circuitry comprises an AC power source of at least one phase, a plurality of heating resistors provided in a spatial arrangement, a number of switches provided between the AC power source and the heating resistors and adapted to switch between ON and OFF states, and a power scheduler arranged to adjust the power fed from the AC power source to the heating resistors at a desired partial-power level by outputting ON/OFF switching signals to the switches. The power scheduler is arranged to generate the switching signals to cause at least some of the switches to switch between the ON and OFF states in a staggered manner so that energization of the partial-power level of different heating resistors takes place, at least partially, non-simultaneously.

The term "heating resistor" means any suitable device which converts electrical power to heat by the effect of flowing electric current and has a defined power consumption and includes, inter alia, mere resistors, incandescent lamps, IR lamps and other IR radiation sources. The heat transfer away from the heating resistor may be by at least one of conduction, convection and or radiation.

The electrical AC power of one or more phases is applied to a plurality of heating resistors which are provided in a spatial arrangement so that the heating resistors generate a desired partial-power level between 0% and 100%, including both extremes. In many cases, the number of heating resistors which are in the ON state remain constant or nearly constant over a period of time so that the power remains essentially constant and only is redistributed over the individual heating resistors during time. In other words, the number of switches in the ON state and the number of switches in the OFF state may remain constant or nearly constant and the ON states and the OFF states only are redistributed among the switches.

Whereas in common solutions, partial-power levels are generated e.g. by phase control, which is associated with high harmonics generation, by pulse width modulation (PWM) control, which is associated with high electromagnetic interference (EMI) generation, or by binary control, which is associated with high flicker generation, the electrical resistor heating circuitry described here provides variable output power with good electromagnetic compatibility (EMC), and the number and cost of components in the resistor heating circuitry is moderate.

In contrast to common heating circuitries, no or very low electromagnetic radiation, no or very low flicker and no or very low harmonics generation is combined with a desired uniform or non-uniform heat generation and distribution.

In contrast to common heating circuitries, neither filters nor snubbers are necessary, so that leakage currents to ground are zero. As the equivalent impedance presented to the AC power supply, i.e. mains, basically is constant over time, flicker generated into the AC power supply goes to zero, the only flicker would be caused for any changes of overall power consumed by the heating circuitry, but can be maintained at a limited level /confined.

If the equivalent impedance presented to the AC power supply has to change, for example due to different power needs of the heating circuitry, the impedance changes, in some examples, are only in the zero crossing of voltage and/or current of the AC supply. Harmonics injected into the AC power supply are zero or nearly zero. The equivalent impedance presented to the AC power supply is purely resistive and the power factor of the heating circuitry is ONE.

The spatial distribution of the heat can be set to an arbitrary distribution, including more homogeneous ones.

In the event of failure of one or more of the heating resistors or one or more of the switches, a soft degradation instead of a catastrophic failure occurs due to inherent redundancy of the circuitry: a failure in one of the resistors can be immediately detected by simply measuring or detecting resistance value, and a temporary fixing can be done/achieved instantaneously, adjacent resistors can be used to compensate for such a failure.

With an increasing number of the switches the power managed by each switch is lower, so that e.g. in MOS technology, the cost of switches decreases.

According to one example, the switching circuitry comprises a set of electrical switches of which each one is connected between the AC power source and one or more of the plurality of heating resistors and is adapted to switch between an ON state and an OFF state in response to the ON/OFF switching signals output from the power scheduler.

The power scheduler may be arranged to generate the ON/OFF switching signals for the switches so as to make them change between the ON state and the OFF state in a given schedule individually and distributed over time so that the average power level of all heating resistors corresponds to the desired power level and corresponds to a desired spatial distribution.

According to one example, the power scheduler is arranged to generate the ON/OFF switching signals so that the switches change between the ON state and the OFF state so as to open when the current is zero and to close when the voltage is zero.

According to one example, the heating circuitry further comprises an electrical power regulator which is arranged to generate power-ordering signals indicating the desired partial-power level and to send the power-ordering signals to the power scheduler, and the power scheduler is arranged to generate the ON/OFF switching signals in response to the power-ordering signals as sent from the power regulator to achieve the desired partial-power level.

According to one example, the power scheduler is arranged to adjust the power fed from the AC power source to the heating resistors so that power is uniformly distributed over the spatial arrangement of the heating resistors.

According to another example, the power scheduler is arranged to adjust the power fed from the AC power source to the heating resistors so that the power is non-uniformly distributed over the spatial arrangement of the heating resistors.

According to one example, the above power regulator is arranged to receive an input signal representing a value from which the desired partial-power level is dependent and is arranged to generate the power-ordering signals dependent on this input signal.

According to one example, the input signal is derived from at least one sensor.

According to further examples, the at least one sensor is at least one of a temperature sensor, an optical sensor and a humidity sensor.

The plurality of heating resistors may be provided in a spatial arrangement in the form of an array comprising at least one column and each column comprising a row of a number of heating resistors.

According to one example, the power scheduler is provided by at least one of a Field Programmable Gate Array (FPGA), a microprocessor, a discrete digital circuitry, an Application Specific Integrated Circuitry (ASIC), a discrete analog circuitry and a sequence generator based on counter addressing a memory device.

According to one example, the resistor heating circuitry is part of an inkjet printer and is arranged for drying a printed substrate.

Another example includes a method of electrical resistor heating with electrical resistor heating circuitry comprising an AC power source of at least one phase, a plurality of heating resistors provided in a spatial arrangement, switching between the AC power source and the heating resistors between ON and OFF states. The method comprises power scheduling to adjust the power fed from the AC power source to the heating resistors at a desired partial-power level by ON/OFF switching a number of switches, wherein the power scheduling causes at least some of the switches to switch between the ON and OFF states in a staggered manner so that energization of the partial-power level of different resistors takes place, at least partially, non-simultaneously.

According to one example, the power scheduling comprises ON/OFF switching of a plurality of heating resistors by a number of electrical switches wherein the ON/OFF switching makes the switches change between the ON state and the OFF state in a given schedule individually and distributed over time so that the average power level of all heating resistors corresponds to the desired power level and corresponds to a desired spatial distribution.

The ON/OFF switching of the plurality of heating resistors by the number of switches in the given schedule may comprise ON switching of a first set of switches among the number of switches and OFF switching of a second set of switches among the number of switches during a given time interval of a number of consecutive time intervals, wherein the number of the switches of the first set and the number of the switches of the second set are selected in correspondence with the desired partial-power level, wherein the switches of the first set and the switches of the second set are ON/OFF switched in a spatial distribution so that one or more switches of the first set alternate with one or more switches of the second set to achieve an approximation of a desired spatial power distribution, and wherein the spatial distribution of the switches of the first set and the switches of the second set is altered in the consecutive time intervals.

According to one example, the spatial distribution of the ON-switched switches of the first set and of the OFF-switched switches of the second set is determined from logical data words or switching commands associated with the consecutive time intervals, wherein the logical data words or switching commands include information defining the ON and OFF states, respectively, of each of the switches of the first set and the second set, and wherein the logical data words or switching commands are established depending on the desired partial-power level and are altered in the consecutive time intervals. The spatial power distribution may be uniform or non-uniform over the spatial arrangement of the heating resistors.

The logical data words or switching commands may be generated by at least one of a Field Programmable Gate Array (FPGA), a microprocessor, a discrete digital circuitry, an Application Specific Integrated Circuitry (ASIC), a discrete analog circuitry and a sequence generator based on counter addressing a memory device.

Although certain products and methods constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

The invention claimed is:

1. A method of heating a printing fluid on a substrate, said method comprising:

determining, by a control unit, partial-power levels for a plurality of heating resistors arranged in a spatial arrangement, the plurality of heating resistors including a first resistor positioned at a first end of the spatial arrangement, a second resistor positioned at a second end of the spatial arrangement, and a third resistor positioned between the first resistor and the second resistor, wherein the determined partial-power levels for the first resistor and the second resistor exceed the determined partial-power level for the third resistor over a predefined time period; and individually controlling, by the control unit, an amount of power fed from a power source to each of the plurality of heating resistors according to the determined partial-power levels, wherein energization of the plurality of heating resistors occurs, at least partially, non-simultaneously over the predefined time period.

2. The method of claim 1, wherein individually controlling the amount of power fed from the power source to each of the plurality of heating resistors further comprises ON/OFF switching the plurality of heating resistors by a number of electrical switches wherein the ON/OFF switching makes the switches change between the ON state and the OFF state according to the determined partial-power levels over the predefined time period.

3. The method of claim 2, wherein ON/OFF switching the plurality of heating resistors by the number of switches comprises ON-switching a first set of switches among the number of switches and OFF-switching a second set of switches among the number of switches during a given time interval of a number of consecutive time intervals, wherein the number of the switches of the first set and the number of the switches of the second set are selected in correspondence with the desired partial-power levels.

4. The method of claim 3, further comprising determining a spatial distribution of the ON-switched switches of the first set and of the OFF-switched switches of the second set from logical data words or switching commands associated with the consecutive time intervals, wherein the logical data words or switching commands include information defining the ON and OFF states, respectively, of each of the switches of the first set and the second set, and wherein the logical data words or switching commands are established depending on the determined partial-power level and are altered in the consecutive time intervals.

5. The method of claim 1, wherein individually controlling the amount of power fed from the power source to each of the plurality of heating resistors further comprises supplying greater amounts of power to the heating resistors positioned to supply heat onto the locations of the substrate on which greater amounts of printing fluid has been applied over the predefined period of time.

6. The method of claim 4, wherein the logical data words or switching commands are generated by at least one of a Field Programmable Gate Array (FPGA), a microprocessor, a discrete digital circuitry, an Application Specific Integrated Circuitry (ASIC), a discrete analog circuitry and a sequence generator based on counter addressing a memory device.

7. The method of claim 1, further comprising:

generating ON/OFF switching signals to cause switches to change between an ON state and an OFF state so as to open when a current is zero and to close when a voltage is zero.

8. A printer comprising:

a print-head to apply a printing fluid onto a print medium, wherein the print medium is to be moved following receipt of the printing fluid;

a plurality of heating resistors positioned downstream of the print-head and in a spatial arrangement with respect to each other to apply heat across a width of the print medium, wherein the plurality of heating resistors includes a first resistor positioned at a first end of the spatial arrangement, a second resistor positioned at a second end of the spatial arrangement, and a third resistor positioned between the first resistor and the second resistor; and a control unit to determine partial-power levels for the plurality of heating resistors to cause the partial-power levels for the first resistor and the second resistor to exceed the desired partial-power level for the third resistor over a predefined time period and to individually control an amount of power fed from a power source to each of the plurality of heating resistors according to the determined partial-power levels, wherein energization of the plurality of heating resistors occurs, at least partially, non-simultaneously over the predefined time period.

9. The printer of claim 8, wherein the control unit is to individually control power fed from the power source to the plurality of heating resistors by supplying greater amounts of power to the heating resistors positioned to supply heat onto the locations of the print medium on which greater amounts of printing fluid has been applied over the periods of time.

10. The printer of claim 9, wherein the control unit is to individually control power fed from the power source to the plurality of heating resistors by supplying greater amounts of power to the first heating resistor and the second heating resistor as compared with the third heating resistor.

11. The printer of claim 8, wherein the control unit is at least one of a Field Programmable Gate Array (FPGA), a discrete digital circuitry, an Application Specific Integrated Circuitry (ASIC), a discrete analog circuitry and a sequence generator based on counter addressing a memory device.

12. A non-transitory computer readable medium on which is stored instructions that when executed by a control unit are to cause the control unit to:

determine partial-power levels for a plurality of heating resistors arranged in a spatial arrangement, the plurality of heating resistors including a first resistor positioned at a first end of the spatial arrangement, a second resistor positioned at a second end of the spatial arrangement, and a third resistor positioned between the first resistor and the second resistor, wherein the determined partial-power levels for the first resistor and the second resistor exceed the determined partial-power level for the third resistor over a predefined time period; and individually control an amount of power fed from a power source to each of the plurality of heating resistors according to the determined partial-power levels such that energization of the plurality of heating resistors occurs, at least partially, non-simultaneously over the predefined time period.

13. The non-transitory computer readable medium of claim 12, wherein to control the amount of power fed from the power source to each of the plurality of heating resistors, the instructions are further to cause the control unit to:

ON/OFF switch the plurality of heating resistors by a number of electrical switches, wherein the ON/OFF switching makes the switches change between the ON state and the OFF state according to the determined partial-power levels over the predefined time period.

14. The non-transitory computer readable medium of claim 13, wherein to ON/OFF switch the plurality of heating resistors, the instructions are further to cause the control unit to:

ON-switch a first set of switches among the number of switches and OFF-switch a second set of switches among the number of switches during a given time interval of a number of consecutive time intervals, wherein the number of the switches of the first set and the number of the switches of the second set are selected in correspondence with the desired partial-power levels.

15. The non-transitory computer readable medium of claim 14, wherein the spatial distribution of the ON-switched switches of the first set and of the OFF-switched switches of the second set is determined from logical data words or switching commands associated with the consecutive time intervals, wherein the logical data words or switching commands include information defining the ON and OFF states, respectively, of each of the switches of the first set and the second set, and wherein the logical data words or switching commands are established depending on the desired partial-power level and are altered in the consecutive time intervals.

16. The non-transitory computer readable medium of claim 12, wherein to individually control the amount of power fed from the power source to each of the plurality of heating resistors, the instructions are further to cause the control unit to:

supply greater amounts of power to the heating resistors positioned to supply heat onto the locations of the substrate on which greater amounts of printing fluid has been applied over a period of time.

* * * * *